United States Patent [19]

Kayyod et al.

[11] Patent Number: 4,711,158

[45] Date of Patent: Dec. 8, 1987

[54] LINEAR MOTION ACTUATOR WITH SPRING CENTERING MEANS

[75] Inventors: Fariborz Kayyod, Anderson, Ind.; Donald E. Hoffman, W. Seneca, N.Y.

[73] Assignee: General Motors Corporation, Detroit, Mich.

[21] Appl. No.: 807,595

[22] Filed: Dec. 11, 1985

[51] Int. Cl.[4] ..... F01B 19/00; F16J 3/00

[52] U.S. Cl. ..... 92/94; 92/98 D; 92/131; 267/166; 403/166

[58] Field of Search ..... 92/85 A, 94, 98 D, 130 C, 92/131; 403/166; 267/166, 169, 170

[56] References Cited

U.S. PATENT DOCUMENTS 742,290 10/1903 Clark ..... 92/130 C X
3,153,988 10/1964 Warstler ..... 92/98 D
3,168,854 2/1965 Neilson ..... 92/131 X
3,253,610 5/1966 Pahl et al. ..... 92/59 X
3,537,355 11/1970 Bliss ..... 92/131 X
3,991,661 11/1976 Mocha ..... 92/131

FOREIGN PATENT DOCUMENTS 326676 11/1957 Switzerland ..... 92/59

*Primary Examiner*—Robert E. Garrett
*Assistant Examiner*—Mark A. Williamson
*Attorney, Agent, or Firm*—R. L. Phillips

[57] ABSTRACT

A vacuum operated actuator is provided with a centering mechanism that operates with a single spring to normally locate the output in a mid-position and also return same from both an extended position and a retracted position. The centering mechanism also includes a connector that may be changed to adjust the output for connection with the device to be actuated without changing the centering and return operation.

3 Claims, 6 Drawing Figures

LINEAR MOTION ACTUATOR WITH SPRING CENTERING MEANS

TECHNICAL FIELD

This invention relates to linear motion actuators and more particularly to a centering mechanism therefor.

BACKGROUND OF THE INVENTION

In linear motion actuators such as the vacuum operated ones used in motor vehicle heating and air conditioning systems, the output apart from being biased to a fully retracted or extended position, is typically adjusted or calibrated at end-use assembly to a desired mid-position by the use of selective springs plus corresponding adjustment and attachment components. This mid-position adjustment thus requires both added components and assembly time.

SUMMARY OF THE INVENTION

The present invention eliminates the need for any such individual adjustment spring and additional parts to be added at installation or for any other final adjustment steps. This is accomplished with a centering mechanism that employs a single compression spring that cooperates with a selective actuator output connector to both center the actuator output at actuator assembly prior to installation as well as provide a cushion against overtravel in both directions. In the preferred construction, the centering mechanism comprises arms which extend from the actuator case longitudinally of the actuator output member. The centering spring is seated at opposite ends on these arms and arranged to engage at these same ends with a selected one of the connectors fixed to the actuator output member to thereby locate and yieldingly hold the latter in a center or mid-position intermediate its fully extended and retracted positions. Then on extension of the actuator output member in one direction from its center position or retraction in the opposite direction, the connector compresses the spring to thus provide for return thereby of the actuator output member to its center position. The connector is adapted to connect the actuator output member to the device to be actuated and is sized lengthwise accordingly so as to locate the connector's point of connection with such device in the required position with the actuator output member thus centered. Thus, the actuator is made readily adaptable by the centering mechanism to different installations through size selection of different length connectors. Furthermore, the centering mechanism allows cushioned overtravel of the actuator output member in either direction by the compression spring also operating as a yielding link when the device being actuated reaches the limits of its travel.

DETAILED DESCRIPTION OF PREFERRED EMBODIMENT

These and other objects, advantages and features of the invention will become more apparent from the following description and drawing in which.

Figure 1:
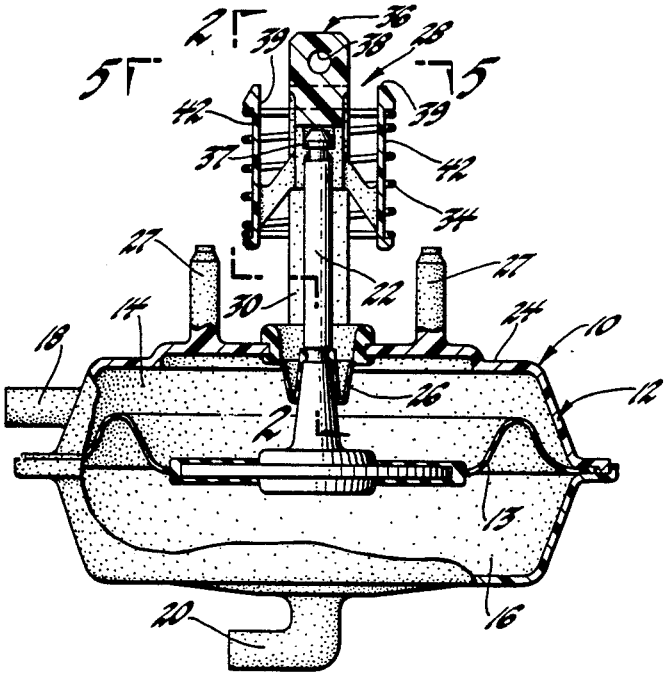
FIG. 1 is a side view with parts broken away of the preferred construction of the invention as adapted to a vacuum actuator for use in a motor vehicle heating and/or air conditioning system and wherein the output member is shown in its centered position.
Figure 3:
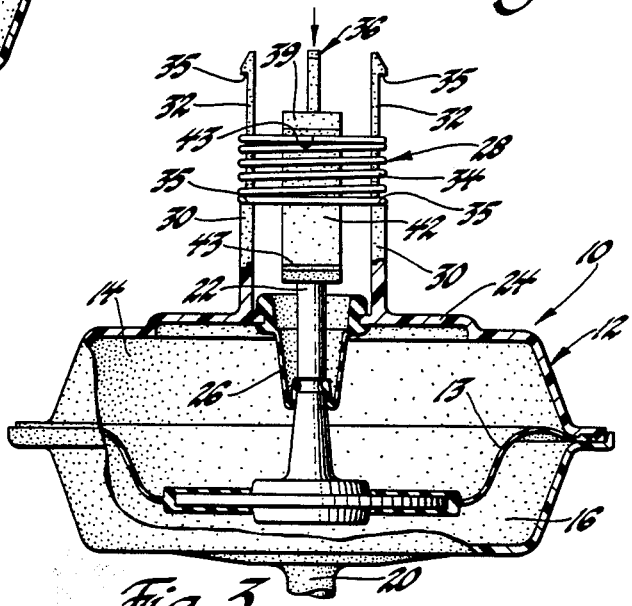
FIG. 3 is a view similar to FIG. 1 but showing the output member in a retracted position.
Figure 4:
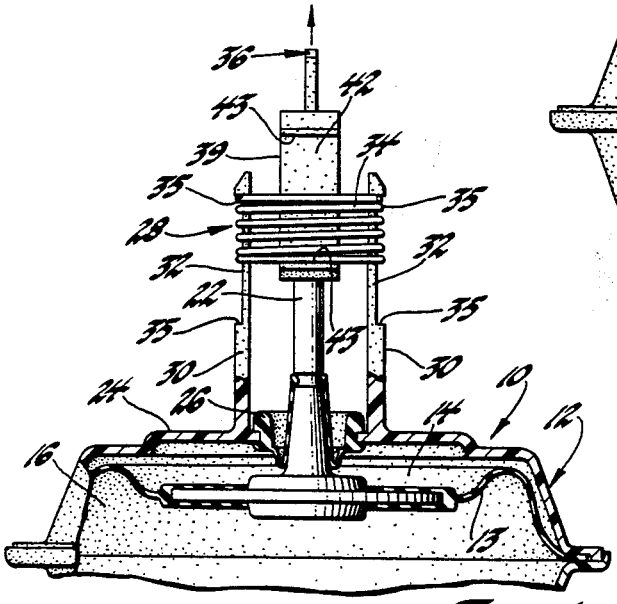
FIG. 4 is a view similar to FIG. 1 but showing the output member in an extended position.

Referring to FIG. 1, there is shown a vacuum operated actuator 10 for operating an air valve (not shown) in a motor vehicle heating and/or air conditioning system. The actuator generally comprises a two-piece injection molded plastic casing 12 whose interior is divided by a diaphragm 13 into two chambers 14, 16 which are alternately connected with engine vacuum and atmosphere via nipples 18, 20 respectively. An output member 22 is centrally fixed to the diaphragm by the latter being molded thereabout. The output member extends out through an opening in the casing half 24 and is sealed to the latter by a rolling type seal 26, the casing being formed on this same side with a pair of integral attaching posts 27 by which the actuator is fixed in the intended installation. With such arrangement and on connection of the chamber 14 with atmosphere and the other chamber 16 with vacuum, the output member 22 is moved linearly by the diaphragm from the center or mid-position shown in FIG. 1 toward the fully retracted position shown in FIG. 3 through a distance directly proportional to the amount of vacuum applied. Alternatively, when these connections are reversed the output member is moved to the fully extended position shown in FIG. 4.

Figure 2:
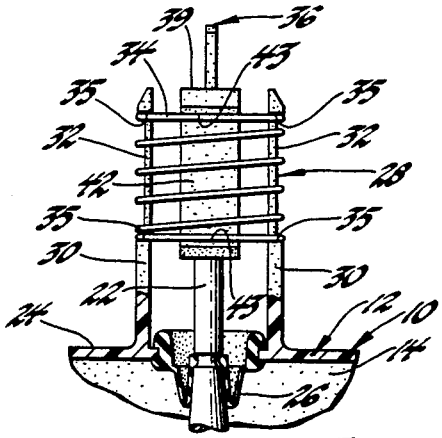
FIG. 2 is a view taken along the line 2—2 in FIG. 1.
Figure 5:
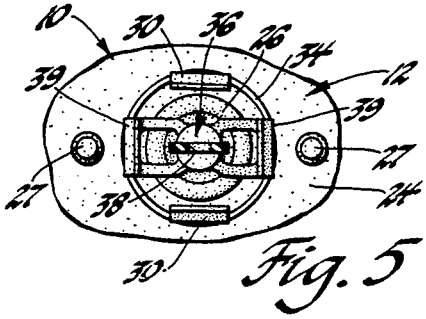
FIG. 5 is a view taken along the line 5—5 in FIG. 1.
Figure 6:
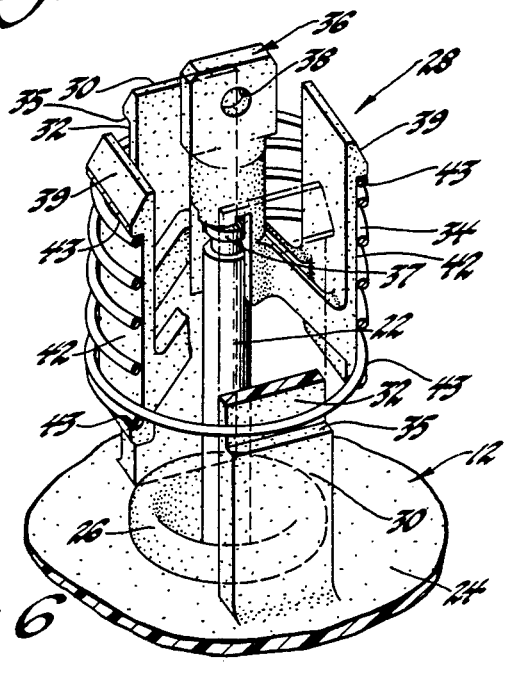
FIG. 6 is an enlarged isometric view of the centering mechanism in FIG. 1.

The present invention is characterized by the centering mechanism generally designated as 28 which operates to center the output member and provide for its return thereto from either an extended or retracted position and moreover is operable to cushion any overtravel when the device being actuated (in this case an air valve) can move no further, e.g. is up against a stop when fully open or fully closed. The centering mechanism comprises a pair of arms 30 formed integral with and extending outward from the casing half 24. The arms 30 are located on opposite sides of the output member diametrically opposite each other and extend longitudinally of and parallel to this member as seen in FIGS. 2, 5 and 6. The arms 30 each has a recess 32 in their outer side to accommodate a compression coil spring 34 which seats at its opposite ends on the ends 35 of these respective recesses. The compression spring is also located in similar fashion with respect to a connector 36 which is fixed at one end by a bayonet connection 37 to the output member and connects by a hole 38 in the other end with the air valve or some other device to be actuated.

The connector 36 is a plastic injection molded part and has a pair of arms 39 which are located on opposite sides of the output member diametrically opposite each other and extend longitudinally of and parallel to this member between the casing arms. The connector arms, like the casing arms, each has a recess 42 in their outer side to also accommodate the compression spring which seats at its opposite ends on the ends 43 of these respective recesses to thus normally locate and yieldingly hold the output member in its mid-position in FIG. 1 and with both the casing and connector arms having chamfered ends to ease the assembly of the spring thereon. Then on movement of the output member and thus the connector in either the retracting direction as shown by the arrow in FIG. 3 or the extending direction as shown by the arrow in FIG. 4 by the application of vacuum to the chambers 16, 14, respectively, the spring is compressed between the trailing seats on the connector (upper ones in FIG. 3 and lower ones in FIG. 4) and the opposed seats on the casing arms (lower ones in FIG. 3 and upper ones in FIG. 4). With the spring thus compressed and then on discontinuance of the vacuum in either of the chambers, the spring operates to return the connector to its normal mid-position. Moreover, the extent of output member travel is determined to be less than that required in either direction so that should the vacuum exceed anticipated levels, the spring then also acts as a counter force to prevent damage to the valve or other parts of the system on actuator overtravel in either direction. Furthermore, since the mid-position of the output member determines the position of the actuator output connector means, i.e. hole 38, and since the location of the latter is determined in part by its location along the length of the connector, the actuator may be readily adapted to applications requiring different locations of the connector hole by simply changing to another connector which differs only as to having the desired connecting hole location along its length while its spring seat relationship remains the same to establish the centering and return operation as before.

The above described preferred embodiment is illustrative of the invention which may be modified within the scope of the appended claims.

The embodiments of the invention in which an exclusive property or privilege is claimed are defined as follows:

1. An actuator having a casing with an interior divided into two chambers by a diaphragm, an output member connected to the diaphragm and extending out through one side of the casing, and the diaphragm being operable in response to pressures in the chambers to move the output member linearly in both an extending direction and a retracting direction, characterized by a centering mechanism comprising a pair of spring seats fixed to the one side of the casing and spaced apart longitudinally of the output member, a pair of spring seats fixed to the output member and spaced apart the same distance as those on the casing so as to be angularly arranged between and radially aligned with the respective seats on the casing, a compression spring arranged between and normally simultaneously seating at opposite ends thereof on the pairs of seats on both the casing and the output member, and the seats on the casing and output member located relative to the extent of output member travel so that the spring operating through all of the seats normally locates and yieldingly holds the output member in mid-position and is compressed between one of the seats on the casing and one of the seats on the output member on pressure induced movement of the output member in both the extending and retracting direction and then on discontinuance of the pressure induced movement operates to return the output member to the mid-position.

2. An actuator having a casing with an interior divided into two chambers by a diaphragm, an output member connected to the diaphragm and extending out through one side of the casing, and the diaphragm being operable in response to pressures in the chambers to move the output member linearly in both an extending direction and a retracting direction, characterized by a centering mechanism comprising a pair of spring seats fixed to the one side of the casing and spaced apart longitudinally of the output member, a connector fixed to the output member, connecting means on the connector for connecting same and thereby the output member to a device to be actuated, a pair of spring seats fixed to the connector and spaced apart the same distance as those on the casing so as to be angularly arranged between and radially aligned with the respective seats on the casing, a compression spring arranged between and normally simultaneously seating at opposite ends thereof on the pair of seats on both the casing and the connector, the seats on the casing and connector located relative to the extent of output member travel so that the spring operating through all the seats normally locates and yieldingly holds the connector in a mid-position and is compressed between one of the seats on the casing and one of the seats on the connector on pressure induced movement of the output member and connector in both the extending and retracting direction and then on discontinuance of the pressure induced movement operates to return the connector to the mid-position, and the connector being interchangeable with another having the same spring seat arrangement but a connecting means located differently longitudinally thereof.

3. An actuator having a casing with an interior divided into two chambers by a diaphragm, an output member connected to the diaphragm and extending out through one side of the casing, and the diaphragm being operable in response to pressures in the chambers to move the output member linearly in both an extending direction and a retracting direction, chracterized by a centering mechanism comprising a pair of arms extending from the one side of the casing and along opposite sides of the output member, the arms each having a pair of spring seats spaced apart longitudinally of the output member, two pair of spring seats fixed to the output member intermediate those on the arms and spaced apart the same distance as those on the arms so as to be angularly arranged between and radially aligned with the respective seats on the casing, a compression spring arranged between and normally simultaneously seating at opposite ends thereof on the pairs of seats on both the casing arms and the output member, and the seats on the casing arms and output member located relative to the extent of output member travel so that the spring operating through all the seats normally locates and yieldingly holds the output member in a mid-position and is compressed between two of the seats on the casing arms and two of the seats on the output member on pressure induced movement of the output member in both the extending and retracting direction and then on discontinuance of the pressure induced movement operates to return the output member to the mid-position.

* * * * *